US008430269B2

(12) United States Patent
Nam

(10) Patent No.: US 8,430,269 B2
(45) Date of Patent: Apr. 30, 2013

(54) TABLET CASSETTE OF AUTOMATIC TABLET PACKING APPARATUS

(75) Inventor: Young Hee Nam, Gwangju (KR)

(73) Assignee: JVM Co., Ltd., Daegu (KR)

( * ) Notice: Subject to any disclaimer, the term of this patent is extended or adjusted under 35 U.S.C. 154(b) by 716 days.

(21) Appl. No.: 12/568,623

(22) Filed: Sep. 28, 2009

(65) Prior Publication Data

US 2010/0078445 A1 Apr. 1, 2010

(30) Foreign Application Priority Data

Sep. 30, 2008 (KR) ..... 10-2008-0095876
Jul. 9, 2009 (KR) ..... 10-2009-0062715

(51) Int. Cl.
*B65H 3/00* (2006.01)

(52) U.S. Cl.
USPC ..... 221/265; 221/154; 221/197; 221/258; 221/263; 221/203; 221/266; 221/186; 221/187; 221/188; 221/225; 221/264; 221/119; 221/2; 221/4; 221/5; 221/91; 221/82; 221/122; 221/168

(58) Field of Classification Search ..... 221/154, 221/197, 265, 258, 263, 203, 266, 186, 187, 221/188, 225, 264, 119, 2, 4, 5, 91, 82, 122, 221/168
See application file for complete search history.

(56) References Cited

U.S. PATENT DOCUMENTS 4,191,308 A * 3/1980 Allen et al. ..... 221/202
4,228,920 A * 10/1980 Burton ..... 221/265
4,485,938 A * 12/1984 Williams ..... 221/154
6,394,308 B1 * 5/2002 Yuyama et al. ..... 221/265
7,014,064 B2 * 3/2006 Asada ..... 221/277
7,040,505 B2 * 5/2006 Hashimoto et al. ..... 221/203
7,131,554 B2 * 11/2006 Hashimoto ..... 221/197
7,581,658 B2 * 9/2009 Mosconi et al. ..... 221/161
7,857,162 B2 * 12/2010 Minami et al. ..... 221/82
7,980,419 B2 * 7/2011 Young et al. ..... 221/167
2005/0269346 A1 * 12/2005 Limback et al. ..... 221/198
2005/0269348 A1 * 12/2005 Limback et al. ..... 221/263
2011/0042404 A1 * 2/2011 Koike et al. ..... 221/2

* cited by examiner

*Primary Examiner* — Gene O. Crawford
*Assistant Examiner* — Rakesh Kumar
(74) *Attorney, Agent, or Firm* — Kile Park Reed & Houtteman PLLC

(57) ABSTRACT

The tablet cassette includes a division block installed to be rotated by a drive motor to discharge tablets introduced from above through transfer passages indented in an outer circumferential surface thereof. Each of the transfer passage includes a separation recess for downward transfer of the tablets, a lower end of which is blocked by a prop, and a supply recess along which the tablets having passed through the separation recess are moved on the outer circumferential surface of the division block to thereby be discharged downward via rotation of the division block. The tablet cassette further includes a bottom ring provided around a lower end of the division block to transfer the tablets located in the separation recess into the supply recess via rotation of the division block.

10 Claims, 15 Drawing Sheets

TABLET CASSETTE OF AUTOMATIC TABLET PACKING APPARATUS

BACKGROUND OF THE INVENTION

1. Field of the Invention

The present invention relates to a tablet cassette of an automatic tablet packing apparatus, and more particularly, to a tablet cassette of an automatic tablet packing apparatus, which is designed to discharge tablets stored in the tablet cassette one by one according to a medical prescription.

2. Description of the Related Art

FIG. 14 illustrates a conventional automatic tablet packing apparatus. In the shown conventional automatic tablet packing apparatus 300, a plurality of tablet cassettes 310 in which tablets are stored is mounted respectively on cassette pedestals 320 attached to shelves of the automatic tablet packing apparatus 300. If a medical prescription is input to a controller of the automatic tablet packing apparatus 300, the controller sends a signal to a motor drive unit that is mounted in the corresponding cassette pedestal 320 on which the tablet cassette 310 receiving desired tablets corresponding to the medical prescription is mounted. Thereby, as a division block, which is mounted in the tablet cassette 310 and is linked to a motor, is rotated, the tablets received in the tablet cassette 310 are discharged one by one through a discharge hole perforated in a lower end of the tablet cassette 310. The discharged tablets are moved downward and collected in a hopper 330, so as to be transported to a packing device that packs the tablets on a per dose basis.

FIG. 15 is a schematic side sectional view of the conventional tablet cassette. As shown, the tablet cassette 310 in which the tablets are stored is mounted on the cassette pedestal 320. A division block 350 is rotatably mounted in the tablet cassette 310, and a motor 400 is mounted in the cassette pedestal 320 to rotate the division block 350. The division block 350 is formed at an outer circumferential surface thereof with a plurality of outwardly raised portions 330. The outwardly raised portions 330 are spaced apart from one another by a predetermined distance, to define separation recesses 340 therebetween.

When the tablets are introduced from above the division block 350, the tablets may become lodged or caught in upper ends of the separation recesses 340. The above described conventional tablet cassette has no configuration to solve the lodging of the tablets and therefore, has difficulty smoothly separating and discharging the tablets.

Further, since the division block tends to be continuously rotated even in the lodged state of the tablets, the lodged tablets become tightly engaged between the division block and an inner surface of the tablet cassette by a rotational force of the division block, resulting in breakage of the tablets.

Furthermore, when particulates of the broken tablets remain on the division block or the inner surface of the tablet cassette, there is a problem in that the particulates are adhered to and mixed with different kinds of medicine.

SUMMARY OF THE INVENTION

Therefore, the present invention has been made in view of the above problems, and it is an object of the present invention to prevent breakage of and damage to tablets as much as possible in the process of discharging the tablets according to a medical prescription.

It is another object of the present invention to prevent sudden stoppage of a motor due to tablets becoming lodged between an inner surface of a tablet cassette and a division block during discharge of the tablets.

It is a further object of the present invention to smoothly supply tablets in succession by allowing the tablets to be aligned in an upright posture prior to passing through an outer circumferential surface of a division block.

In accordance with an aspect of the present invention, the above and other objects can be accomplished by the provision of a tablet cassette of an automatic tablet packing apparatus including a tablet cassette body including a receptacle portion having an open upper end, and a cylindrical portion formed below the receptacle portion and having a closed circular lower surface, the circular lower surface of the cylindrical portion being formed at the center thereof with a circular shaft hole, into which a pinion of a cassette pedestal is inserted, and also, at an outer circumferential position thereof with a discharge hole for discharge of a tablet, and a division block rotatably arranged inside the cylindrical portion, the division block having a cylindrical recess indented in the center of a lower surface thereof for engagement of the pinion and at least one transfer passage indented in an outer circumferential surface thereof to transfer the tablet introduced into the receptacle portion downward, wherein the transfer passage includes a separation recess for downward transfer of the tablet, a lower end of which is blocked by a prop, and a supply recess along which the tablet having passed through the separation recess is moved on the outer circumferential surface of the division block to thereby be discharged downward via rotation of the division block, and a bottom ring is provided around a lower end of the division block to transfer the tablet located in the separation recess into the supply recess via rotation of the division block, the bottom ring having an opening for discharge of the tablet.

The bottom ring may include a passage edge surface located lower than the prop, an inclined edge surface to cause the tablet located in the separation recess to be moved upward in the separation recess so as to be transferred to the supply recess, and a supporting edge surface located higher than the prop, the passage edge surface, inclined edge surface, and supporting edge surface being formed in succession.

The bottom ring may include an inclined edge surface obliquely extending from a position lower than the prop to a position higher than the prop, to cause the tablet located in the separation recess to be moved upward in the separation recess so as to be transferred to the supply recess, and a supporting edge surface extending from the inclined edge surface and located higher than the prop, the inclined edge surface and supporting edge surface being formed in succession.

To prevent the tablet from being unintentionally transferred from the separation recess to the supply recess, the prop may include a protuberance to prevent the tablet supported on the prop from being unintentionally transferred into the supply recess.

The tablet cassette may further include an opening/closing unit to open or close the discharge hole through which the tablet having passed through the transfer passage is discharged.

BRIEF DESCRIPTION OF THE DRAWINGS

The above and other objects, features and other advantages of the present invention will be more clearly understood from the following detailed description taken in conjunction with the accompanying drawings, in which:

FIG. 8 illustrates downward movement of tablets, FIG. 9 illustrates lateral movement of the tablets, FIG. 10 illustrates a position where the lateral movement of the tablets is terminated, and FIG. 11 illustrates discharge of the tablets;

DETAILED DESCRIPTION OF THE INVENTION

Hereinafter, functions, configurations, and operations of a tablet cassette of an automatic tablet packing apparatus according to exemplary embodiments of the present invention will be described in detail with reference to the accompanying drawings.

Figure 1:
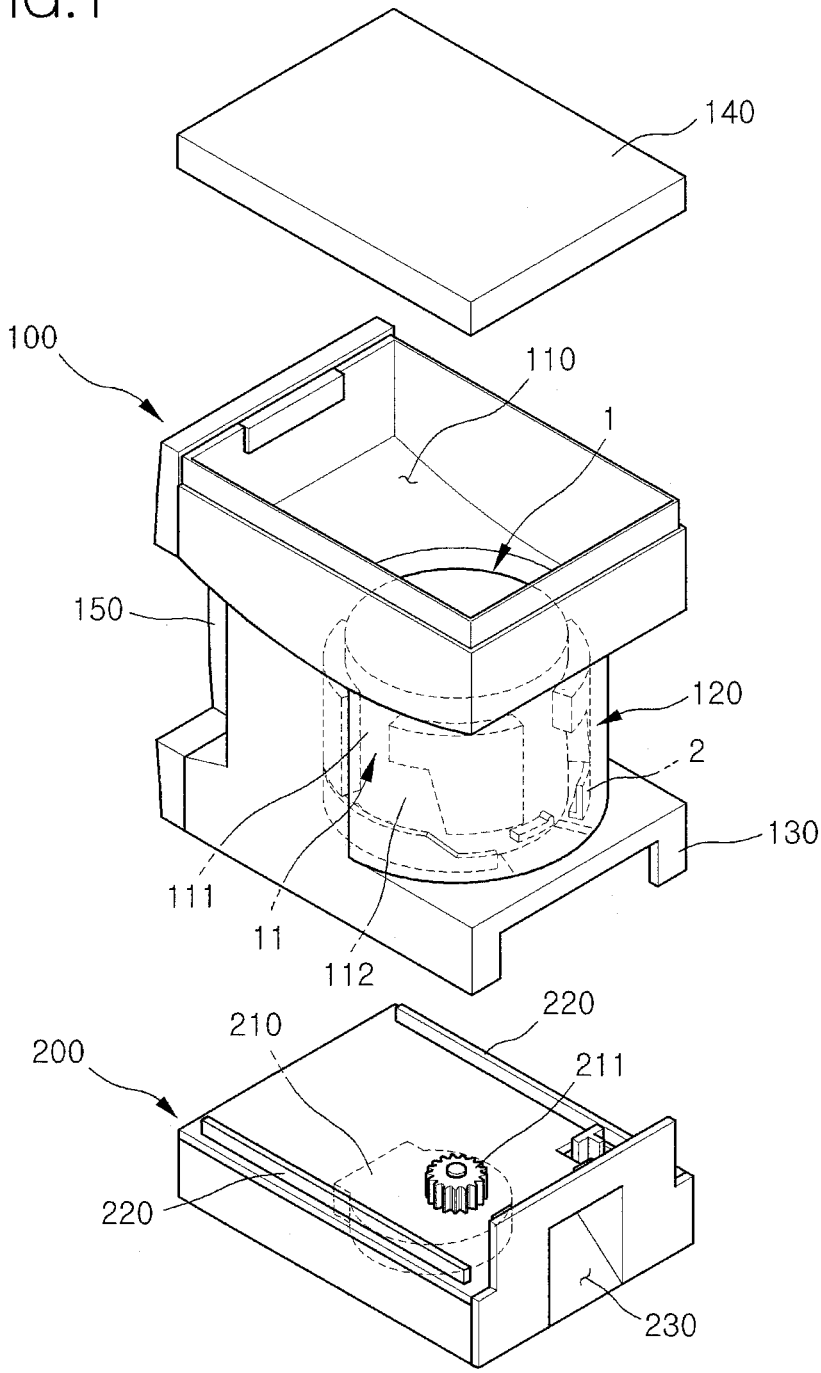
FIG. 1 is a perspective view illustrating a tablet cassette of an automatic tablet packing apparatus according to a first embodiment of the present invention.
Figure 2:
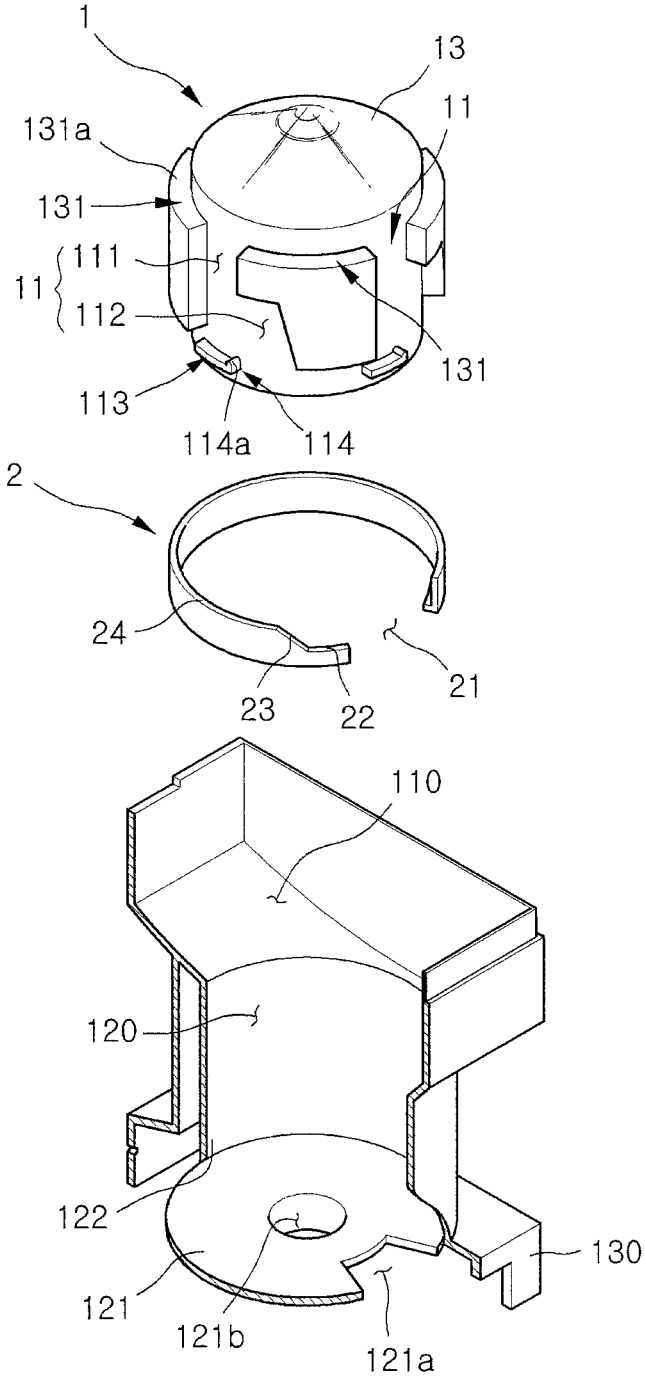
FIG. 2 is an exploded perspective view of the tablet cassette of the automatic tablet packing apparatus shown in FIG. 1.

FIG. 1 is a perspective view illustrating a tablet cassette of an automatic tablet packing apparatus according to the present invention, and FIG. 2 is an exploded perspective view of the tablet cassette of the automatic tablet packing apparatus shown in FIG. 1.

The tablet cassette 100 is detachably mounted to a corresponding one of a plurality of cassette pedestals 200 that are mounted on shelves of the automatic tablet packing apparatus. The tablet cassette 100 includes a cassette body in which tablets are received, a division block 1 mounted in the cassette body, and a cover 140 coupled to an upper end of the cassette body.

The cassette body consists of a receptacle portion 110, a cylindrical portion 120 located below the receptacle portion 110, and a cassette supporting portion 130 located below the cylindrical portion 120. The receptacle portion 110 has an open upper end for entrance of the tablets. The cylindrical portion 120 has a closed circular lower surface 121. A circular shaft hole 121*b* is perforated in the center of the circular lower surface 121, so that a pinion 211 of the cassette pedestal 200 is inserted through the circular shaft hole 121*b*. In addition, the circular lower surface 121 is formed at an outer circumference thereof with a discharge hole 121*a* for discharge of the tablets.

The division block 1 is rotatably received in the cylindrical portion 120. The division block 1 has a cylindrical recess indented from the center of a lower surface thereof. The cylindrical recess has a jagged inner circumferential surface for coupling of the pinion 211. As the pinion 211 is engaged in the cylindrical recess, the division block 1 can be rotated by rotation of a motor, causing the tablets to be discharged through the discharge hole 121*a* one by one.

The division block 1 has a conical upper surface 13. Specifically, the upper surface 13 of the division block 1 is inclined downward from the center to the edge thereof so that the tablets, which are introduced from above the division block 1, are moved toward an outer circumferential surface of the division block 1 by gravity or vibration caused during intermittent rotation of the division block 1.

The outer circumferential surface of the division block 1 below the conical upper surface 13 is formed with outwardly raised portions 131 at positions with a predetermined distance from the edge of the conical upper surface 13. The outwardly raised portions 131 are spaced apart from one another by a predetermined distance, to define transfer passages 11 for vertical discharge of the tablets therebetween. Each of the transfer passages 11 consists of a separation recess 111 and a supply recess 112. The separation recess 111 serves to guide the tablets downward, a lower end of the separation recess 111 being blocked by a prop 113. Once the tablets have passed through the separation recess 111 rotation of the division block 1, the tablets are discharged downward through the supply recess 112.

With the above described configuration, when the tablets are introduced from above the division block 1, the tablets are moved from the conical upper surface 13 into a gap between the cylindrical portion 120 of the cassette body and the outwardly raised portions 131 of the division block 1. In this case, a distance between the division block 1 and the cylindrical portion 120 is determined such that some of the tablets are aligned in an upright posture on upper surfaces 131*a* of the outwardly raised portions 131, and the remaining tablets are moved into the separation recesses 111. The upper surfaces 131*a* of the outwardly raised portions 131*a* may be horizontal, or may be inclined toward the neighboring separation recesses 111, to allow the tablets aligned on the upper surfaces 131*a* of the outwardly raised portions 131 to be easily moved into the separation recesses 111.

A bottom ring 2 is provided around a lower end of the division block 1. The bottom ring 2 has an opening 21 for discharge of the tablets. Upon rotation of the division block 1, the tablets, arranged in the separation recesses 111 and the supply recesses 112, are moved to the discharge hole 121*a* through the opening 21 of the bottom ring 2.

The cassette pedestal 200 includes guide rails 220 protruding from an upper surface thereof for sliding coupling of the tablet cassette 100, and a drive motor 210 mounted in the center of an interior space thereof, the drive motor 210 being rotated in response to a control signal transmitted from a control unit (not shown) of the automatic tablet packing apparatus. The pinion 211 is mounted on the upper surface of the cassette pedestal 200 to protrude upward and is rotated upon receiving a rotational force of the drive motor 210. Once the tablet cassette 100 is mounted on the cassette pedestal 200, the pinion 211 is coupled to the lower end of the division block 1, enabling rotation of the division block 1. In addition, the cassette pedestal 200 is formed at one side thereof with a discharge port 230, through which the tablets having passed through the discharge hole 121*a* of the tablet cassette 100 are discharged.

The cover 140 is coupled to the upper end of the tablet cassette 100 and although not shown, a handle may be formed at an outer edge of the cover 140.

Referring to FIG. 2, the props 113 protrude outward from the outer circumferential surface of the division block 1 at the lower ends of the respective separation recesses 111. The props 113 serve to receive and support the tablets dropping from above, allowing the tablets to be moved into the supply recesses 112 by the bottom ring 2 as will be described hereinafter and subsequently, be discharged downward from, the supply recesses 112.

The bottom ring 2 takes the form of an arcuate strip fixedly attached to an inner circumferential surface 122 of the cylindrical portion 120 at a position adjacent to the circular lower surface 121. The bottom ring 2 is configured to surround the outer circumferential surface of the lower end of the division block 1 with a predetermined distance from the division block 1, to assure smooth rotation of the division block 1.

The opening 21 of the bottom ring 2 is formed by cutting out a partial region of the bottom ring 2 above the discharge hole 121*a*, to allow the tablets to be discharged to a packing device through the discharge hole 121*a*. Assuming that both distal ends of the bottom ring 2 defining the opening 21 therebetween include a leading end and a trailing end with respect to a rotating direction of the division block 1, the bottom ring 2 is sequentially formed starting from the leading end with a passage edge surface 22, an inclined edge surface 23, and a supporting edge surface 24. The passage edge surface 22 is a horizontal surface located lower than the props 113. The inclined edge surface 23 obliquely extends upward from the passage edge surface 22 and in turn, the supporting edge surface 24 extends horizontally from an upper end of the inclined edge surface 23, the supporting edge surface 24 being located higher than the props 113. The supporting edge surface 24 maintains the same height as the trailing end of the bottom ring 2.

Figure 3:
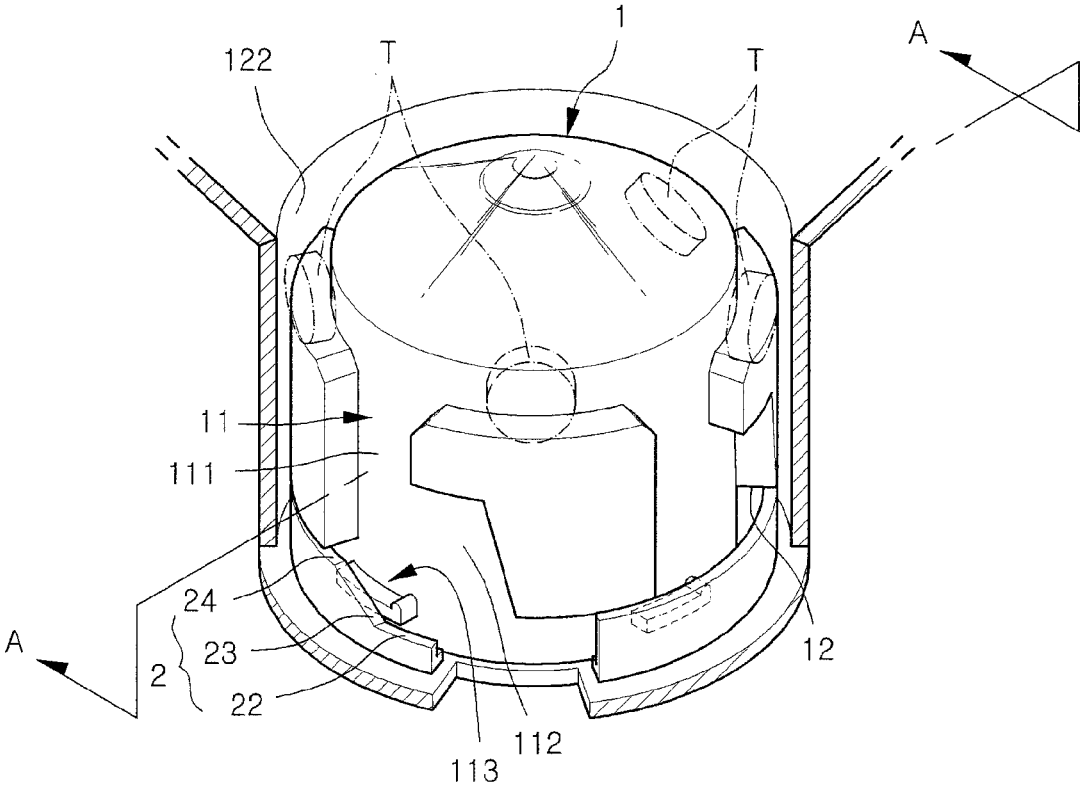
FIG. 3 is a partial perspective view illustrating the coupling relationship between a division block and a bottom ring provided in the tablet cassette of the automatic tablet packing apparatus shown in FIG. 1.

Referring to FIG. 3, the passage edge surface 22 is located lower than the props 113 provided at the division block 1, whereas the supporting edge surface 24 is located higher than the props 113.

Now, the coupling relationship between the division block 1 and the bottom ring 2 will be described in more detail with reference to FIGS. 3 and 4. FIG. 3 is a view schematically illustrating the bottom ring 2 and the division block 1 mounted in the cylindrical portion 120. As can be seen from FIG. 3, to prevent the tablets from becoming lodged in a gap between the props 131 formed at the outer circumferential surface of the division block 1 and the inner circumferential surface 122 of the cylindrical portion 120 of the tablet cassette 100, the props 131 are spaced apart from the inner circumferential surface 122 by a distance smaller than a width of the tablets T.

Figure 4:
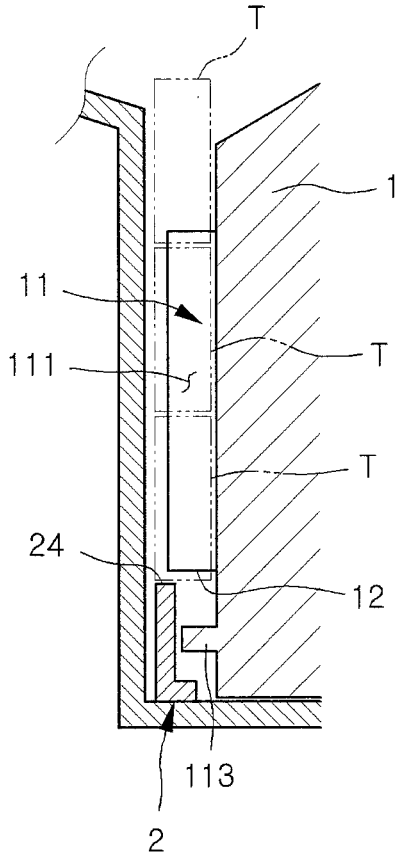
FIG. 4 is a partial sectional view taken along the line A-A of FIG. 3.

As shown in FIG. 4, a lowermost one of the tablets T received in the separation recess 111 is first supported on the supporting edge surface 24 of the bottom ring 2. Then, after the tablet T reaches the passage edge surface 22 of the bottom ring 2 via rotation of the division block 1, the tablet T is supported on the prop 113. Preferably, a distal end of the prop 113 is formed with a protuberance 114 to prevent the tablet T from being unintentionally moved into the supply recess 112. By preventing the tablet T supported on the prop 113 from being unintentionally moved into the supply recess 112, the tablets are able to be discharged one by one through the discharge hole 121*a* upon rotation of the division block 1 only when a position of the supply recess 112 coincides with the opening 21 of the bottom ring 2 and the discharge hole 121*a*.

Figure 5:
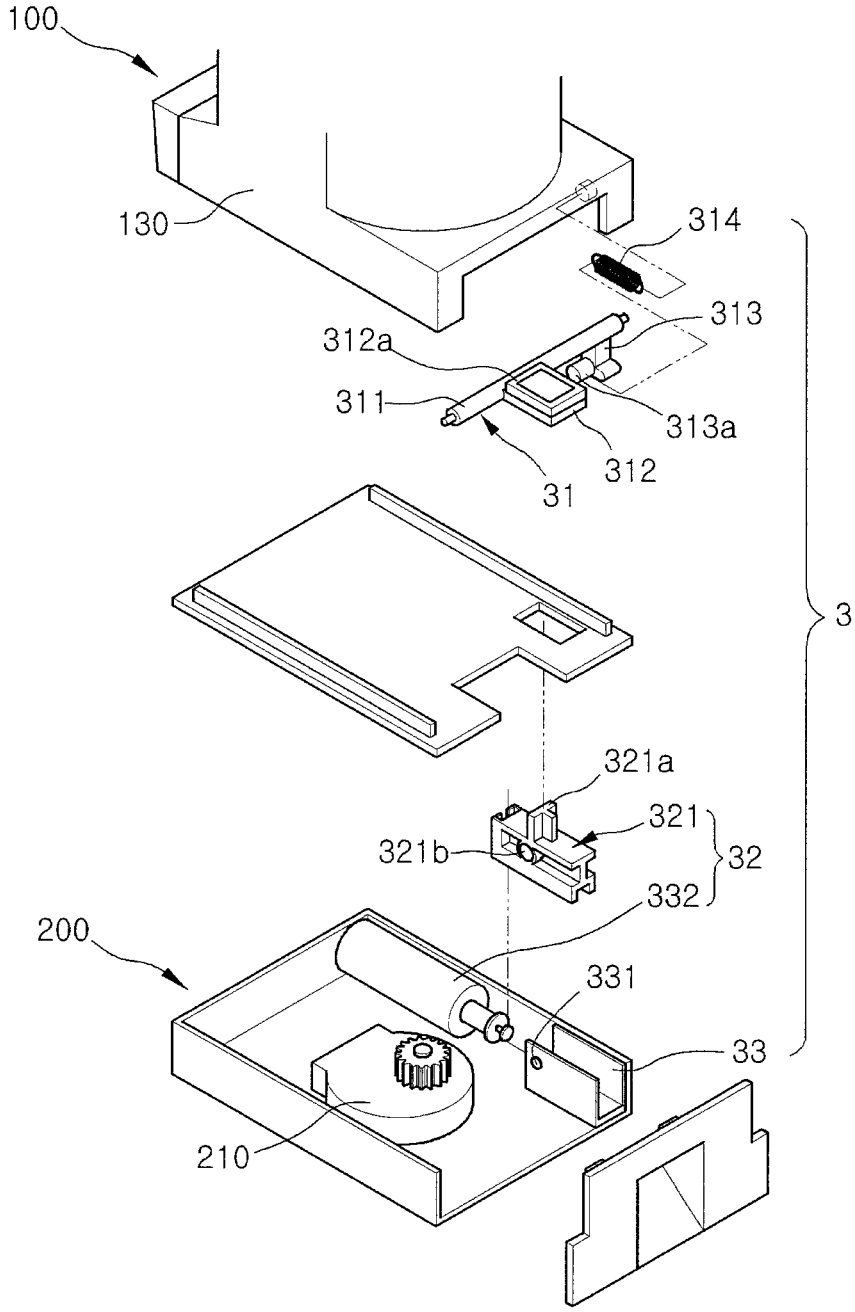
FIG. 5 is an exploded perspective view illustrating an opening/closing unit provided in the tablet cassette of the automatic tablet packing apparatus according to the first embodiment of the present invention.
Figure 6:
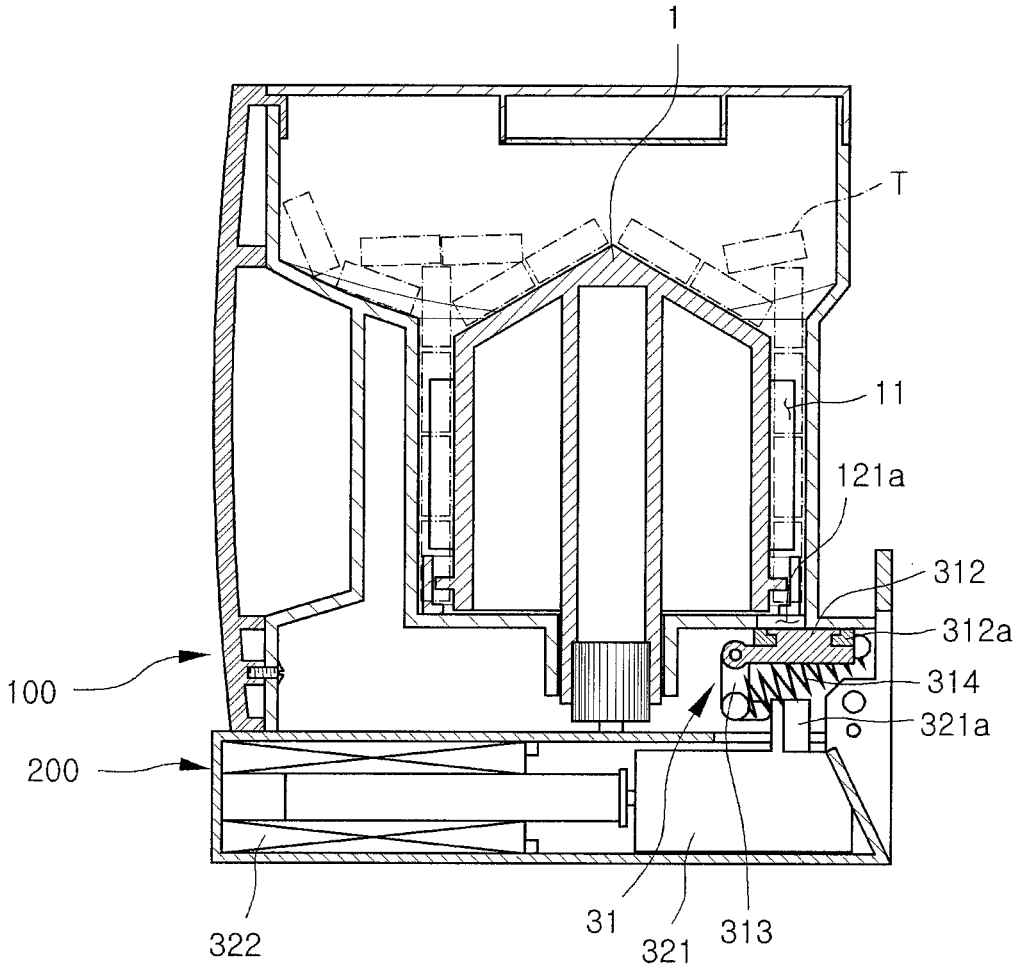
FIG. 6 is a sectional view illustrating a closed state of the opening/closing unit shown in FIG. 5.
Figure 7:
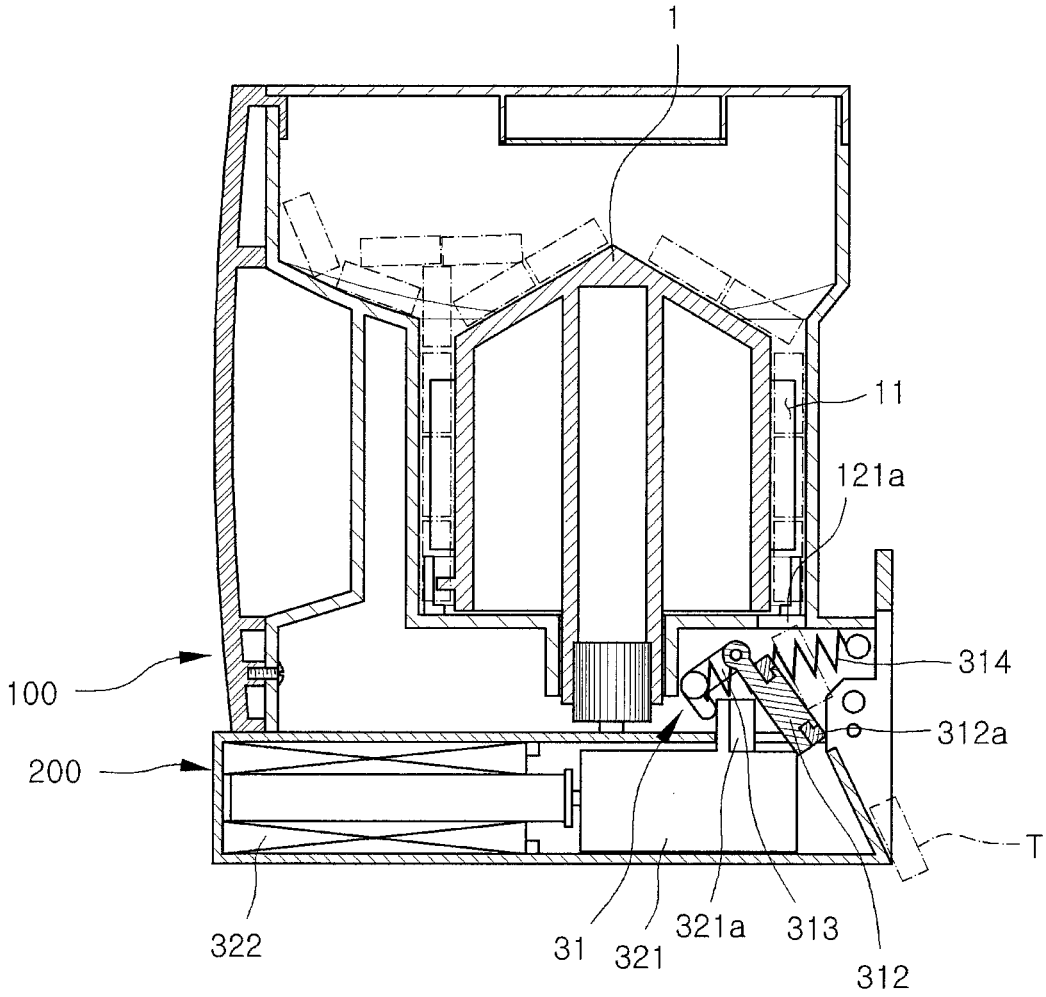
FIG. 7 is a sectional view illustrating an open state of the opening/closing unit shown in FIG. 5.

FIG. 5 is an exploded perspective view illustrating an opening/closing unit provided in the tablet cassette of the automatic tablet packing apparatus, and FIGS. 6 and 7 are sectional views respectively illustrating a closed state and an open state of the opening/closing unit.

To prevent the tablets received in the tablet cassette 100 from being continuously exposed to outside air, the opening/closing unit 3 may be further provided to open or close the discharge hole 121*a* through which the tablets having passed through the transfer passages 11 of the division block 1 are discharged.

The opening/closing unit 3 opens the discharge hole 121*a* when it is desired to discharge the tablets having passed through the transfer passages 11, and hermetically closes the discharge hole 121*a* to prevent the tablets from being exposed to the outside air at ordinary times irrespective of discharge of the tablets.

The opening/closing unit 3 is mounted to the cylindrical portion 120 at a position adjacent to the discharge hole 121*a*. The opening/closing unit 3 is operated to open the discharge hole 121*a* when the supply recess 112 is aligned immediately above the discharge hole 121*a* via rotation of the division block 1. For this, the operation of the opening/closing unit 3 is preferably controlled by the control unit (not shown) of the automatic tablet packing apparatus, together with rotational operation of the drive motor 210.

The opening/closing unit 3 includes an opening/closing door unit 31 and an opening/closing actuating unit 32. The opening/closing door unit 31 is mounted to the cassette supporting portion 130 defining a lower portion of the tablet cassette 100. The opening/closing actuating unit 32 is mounted in the cassette pedestal 200 to open the discharge hole 121*a* by actuating the opening/closing door unit 31.

The opening/closing door unit 31 includes a rotating shaft 311 both left and right ends of which are rotatably hinged to the tablet cassette 100. The opening/closing door unit 31 further includes a door plate 312, an operating bar 313, and a spring 314, which are integrally formed with the rotating shaft 311. The door plate 312 is configured to come into contact with a lower end of the discharge hole 121*a* to hermetically close the discharge hole 121*a*. The operating bar 313 serves to initiate rotational operation of the rotating shaft 311, and the spring 314 serves to return the operating bar 313 to an original position thereof and consequently, to return the rotating shaft 311 to an original position thereof.

In this case, the door plate 312 has a larger area than the discharge hole 121*a*, to completely cover the discharge hole 121*a*. In addition, a pad 312*a* made of an elastic material, such as, e.g., rubber, may be further attached to an upper surface or an outer circumferential surface of the door plate 312 in contact with an imaginary bottom plane of an interior space of the discharge hole 121*a*, to enhance air tightness of the discharge hole 121*a*. Thereby, the door plate 312 is brought into contact with or is separated from the discharge hole 121*a* according to a rotating direction of the rotating shaft 311, thereby serving to close or open the discharge hole 121*a*.

The operating bar 313 extends from the rotating shaft 311 and is adapted to be caught by a holder of a transfer piece that will be described hereinafter, thereby causing rotation of the rotating shaft 311. The operating bar 313 is formed with a protuberance 313*a* by which one end of the spring 314 is caught.

One end of the spring 314 is caught by the protuberance 313*a* of the operating bar 313, and the other end of the spring 314 is mounted to the tablet cassette 100. The spring 314 acts to pull the operating bar 313, thereby providing a pulling force required to cause the door plate 312 to close the discharge hole 121*a*. More specifically, the door plate 312 is forced to close the discharge hole 121*a* by the pulling force of the spring 314 at ordinary times. Then, when the rotating shaft 311 is rotated by the opening/closing actuating unit 32 to separate the door plate 312 from the discharge hole 121*a*, the spring 314 is tensioned, thereby exhibiting restoration force to rotate and return the rotating shaft 311 to an original position thereof.

The opening/closing actuating unit 32 is mounted in the cassette pedestal 200 and includes a transfer piece 321 and a solenoid 322.

A U-shaped transfer channel 33 is mounted in the cassette pedestal 200 and the transfer piece 321 is placed on the bottom of the transfer channel 33. Thereby, the transfer piece 321 can slide forward or rearward inside the transfer channel 33.

The transfer piece 321 is formed at an upper surface thereof with a holder 321*a*. The holder 321*a* protrudes upward through an opening perforated in the upper surface of the cassette pedestal 200. When the tablet cassette 100 is mounted on the cassette pedestal 200, the holder 321*a* is brought into contact with a front surface of the operating bar 313.

The solenoid 322 is mounted in the cassette pedestal 200 and is coupled to a rear end surface of the transfer piece 321. The transfer piece 321 slides rearward along the transfer channel 33 via operation of the solenoid 322, causing the operating bar 313 to be moved rearward by the holder 321*a* and simultaneously, the rotating shaft 311 of the opening/closing door unit 31 to be rotated. With rotation of the opening/closing door unit 31, the door plate 312 opens the discharge hole 121 to allow the tablets to be discharged through the discharge hole 121*a* and also, the spring 314 is tensioned.

Thereafter, if power supplied to the solenoid 322 is cut off, the opening/closing actuating unit 32 is rotated reverse by restoration force of the spring 314, causing the door plate 312 to close the discharge hole 121*a* and the transfer piece 321 to be returned forward by the operating bar 313.

To sense the above described opening/closing operation of the opening/closing unit 3, the transfer piece 321 may be provided with a magnet 321*b*, and the transfer channel 33, along which the transfer piece 321 slides forward or rearward, may be provided with a magnetic force sensor 331 to sense a magnetic force of the magnet 321*b*.

More specifically, the magnet 321*b* is inserted in the transfer piece 321 at a position immediately below the holder 321*a*. The magnetic force sensor 331 to sense the magnetic force of the magnet 321*b* is attached to the transfer channel 33 at a position corresponding to a position of the magnet 321*b* when the discharge hole 121*a* is opened.

With the above described configuration, when the transfer piece 321 is moved rearward by operation of the solenoid 322, the magnetic force sensor 331 can recognize the rearward movement of the transfer piece 321 by sensing the magnetic force of the magnet 321*b*. The magnetic force sensor 331 transmits a sensed signal to the control unit, allowing the control unit to confirm implementation of a normal opening operation.

If the magnetic force sensor fails to sense the magnetic force despite a solenoid operating command, or the magnetic force sensor 331 senses the magnetic force even after power supplied to the solenoid valve is cut off, this situation is referred to as malfunction of the opening/closing unit 3. Accordingly, a user is informed of the malfunction of the opening/closing unit 3 via known means, such as e.g. an alarm sound and image, enabling the user to rapidly perform inspection.

Accurately sensing whether the opening/closing unit 3 is normally operated as described above has the effect of actively preventing the tablets from being exposed to the outside air and consequently, actively preventing contamination of the tablets.

Figure 8:
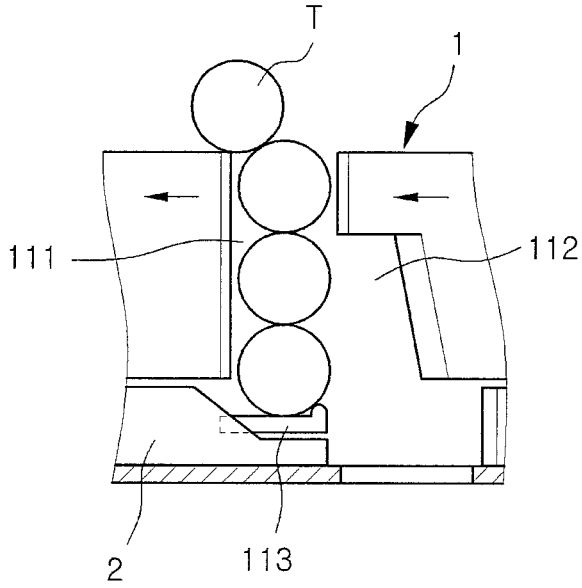
FIGS. 8 to 11 are conceptual views illustrating the use sequence of the tablet cassette of the automatic tablet packing apparatus shown in FIG. 1.

Hereinafter, FIGS. 8 to 11 illustrate the operation of the tablet cassette of the automatic tablet packing apparatus. Specifically, FIG. 8 illustrates vertical movement of the tablets.

Once the tablets T are introduced into the receptacle portion 110 from above the tablet cassette 100, the tablets T are moved down along the conical upper surface 13 of the division block 1 or an inclined inner wall surface of the receptacle portion 100. Thereby, some of the tablets T are aligned in an upright posture on the outwardly raised portions 131 of the division block 1, and the remaining tablets T are moved into the separation recesses 111. The tablets T moved into each separation recess 111 may be supported by the prop 113, or may be supported on the supporting edge surface 24 of the bottom ring 2 as shown in FIG. 7.

Figure 9:
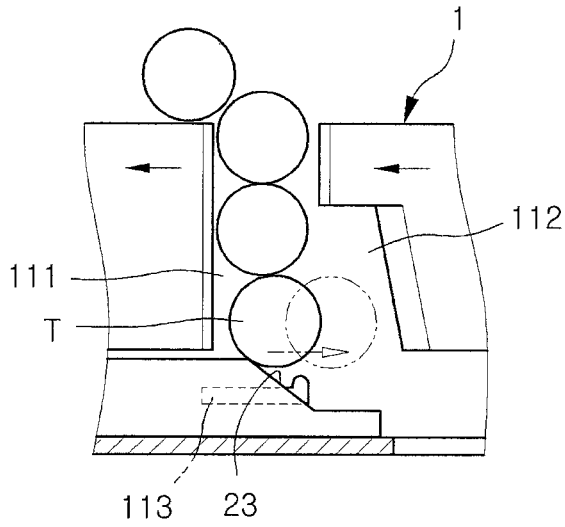

Next, referring to FIG. 9, as the division block 1 is rotated, a lowermost one of the tablets T supported on the prop 113 is moved upward in the separation recess 111 along the inclined edge surface 23 of the bottom ring 2, thereby being obliquely supported by the inclined edge surface 23. Thereby, the tablet T has an effect on a lateral force (designated by the dashed hollow arrow) that pushes the tablet T toward the supply recess 112. In a state wherein the tablet T is moved upward by the inclined edge surface 23, the tablet T is located higher than the prop 113.

Figure 10:
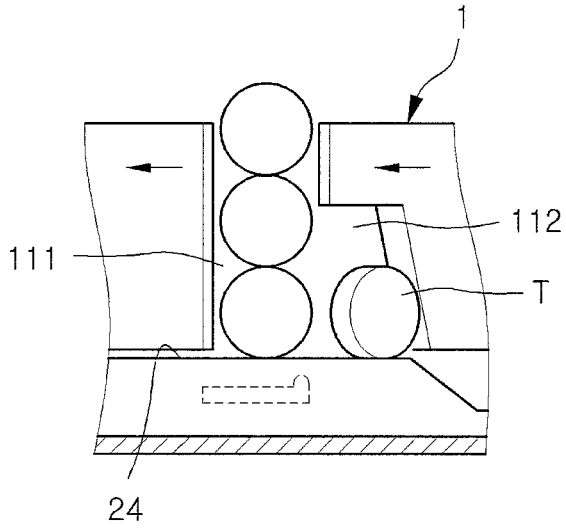

Next, referring to FIG. 10, as the division block 1 is further rotated, the tablet T is moved to and received in the supply recess 112. Even if the tablet T is vertically moved upward in the separation recess 111 rather than being introduced into the supply recess 112, the tablet T is forced to be moved into the supply recess 112 via frictional force between the tablet T and the supporting edge surface 24 caused when the division block 1 is rotated.

If an empty space occurs in the separation recess 111 as the tablet T is moved into the supply recess 112, an immediately above tablet drops into the empty space.

Figure 11:
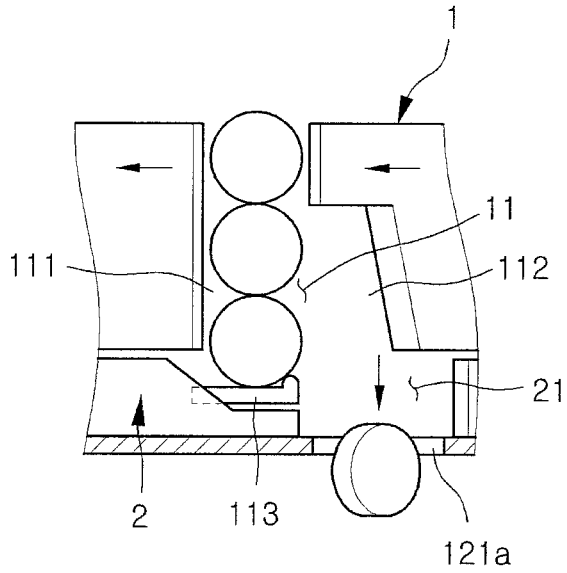

Next, referring to FIG. 11, when the discharge hole 121*a* is located immediately below the supply recess 112 as the division block 1 is further rotated, the tablet T located in the supply recess 112 is discharged downward through the discharge hole 121*a*. On the other hand, the tablet T located in the separation recess 111 drops as soon as the transfer passage 11 passes over the opening 21 of the bottom ring 2, thereby being supported on the prop 113.

As the above described movement operation is repeated via rotation of the division block 1, all the tablets T received in the tablet cassette 100 can be discharged through the discharge hole 121*a* one by one.

Figure 12:
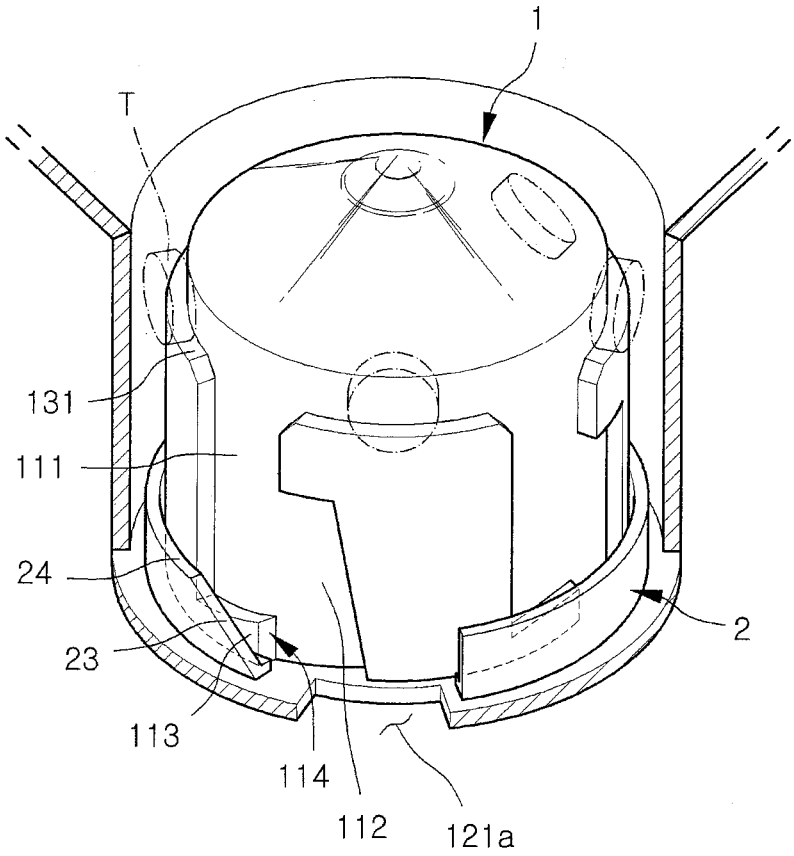
FIG. 12 is a partial perspective view illustrating the coupling relationship between the division block and the bottom ring provided in the tablet cassette of the automatic tablet packing apparatus according to a second embodiment of the present invention.
Figure 13:
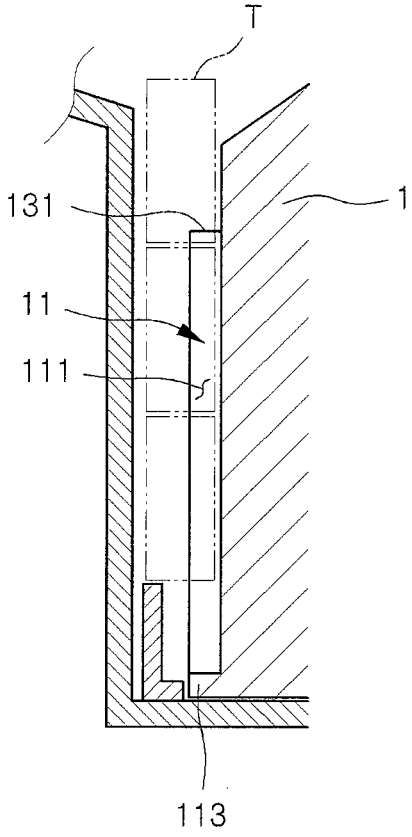
FIG. 13 is a partial sectional view of FIG. 12.
Figure 14:
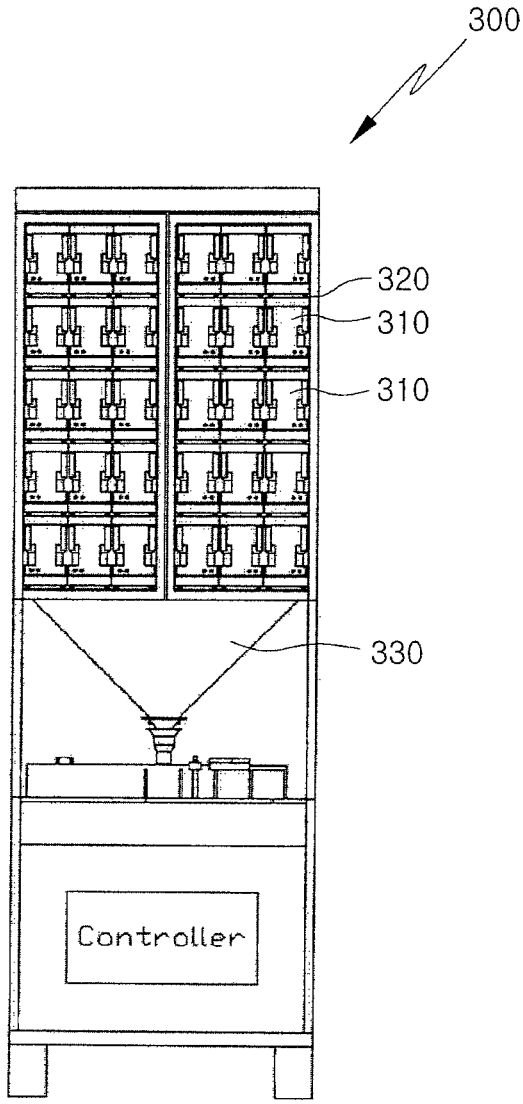
FIG.14 Prior Art
FIG. 14 is a view illustrating a conventional automatic tablet packing apparatus.
Figure 15:
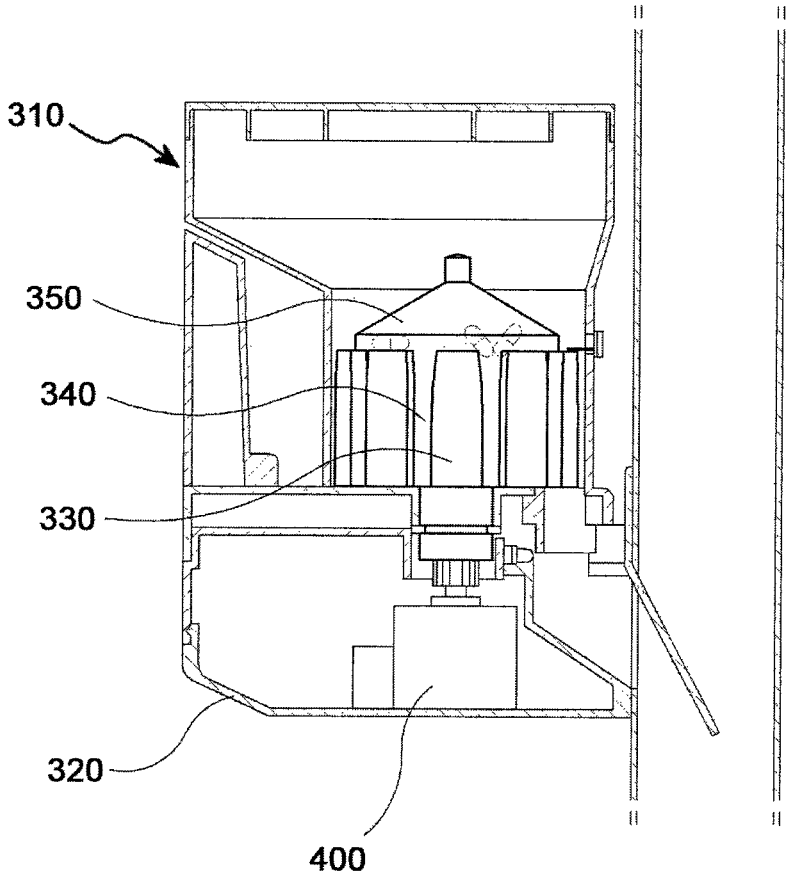
Fig.15 Prior Art
FIG. 15 is a sectional view of the conventional automatic tablet packing apparatus.

FIG. 12 is a partial perspective view illustrating the coupling relationship between the division block and the bottom ring provided in the tablet cassette of the automatic tablet packing apparatus according to a second embodiment of the present invention, and FIG. 13 is a partial sectional view of FIG. 12.

The division block 1, provided in the tablet cassette 100 of the automatic tablet packing apparatus according to the second embodiment of the present invention is configured in such a manner that the transfer passage 11 has a depth equal to half of the thickness of the tablet T. In addition, when the tablet T is aligned in an upright posture on the upper surface

131*a* of the outwardly raised portion 131 of the division block 1, approximately half of the bottom of the tablet T (i.e. half of the bottom close to the division block 1) is supported on the upper surface 131*a* of the outwardly raised portion 131.

The separation recess 111, the supply recess 112, and the prop 113, which constitute the transfer passage 11, are brought into contact with an upright surface of the tablet T, acting to limit a movement range of the tablet T.

In the present embodiment, an outer diameter of the bottom ring 2 is larger than an outer diameter of the division block 1. With this configuration, the supporting edge surface 24 and a part of the inclined edge surface 23 of the bottom ring 2 may be located higher than the lower end of the transfer passage 11. In this case, in the same manner as that of the previously described first embodiment, the bottom ring 2 comes into contact with an outer surface (i.e. a surface close to an imaginary inner surface of an interior space defined between the bottom ring 2 and the division block 1) of the tablet T received in the transfer passage 11, thereby functioning to transfer the tablet from the separation recess 111 into the supply recess 112.

More specifically, the inclined edge surface 23 of the bottom ring 2 obliquely extends from a position lower than the prop 113 to a position higher than the prop 113, to cause the tablet located in the separation recess 111 to be moved upward in the separation recess 111 and then, to be transferred into the supply recess 112. In addition, the supporting edge surface 24 of the bottom ring 2 extends horizontally from the upper end of the inclined edge surface 23 and is located higher than the prop 113.

In this case, a lower distal end of the inclined edge surface 23 is preferably spaced apart from the discharge hole 121*a* by a predetermined distance with respect to the rotating direction of the division block 1, to prevent the tablet from dropping to the discharge hole 121*a* prior to being completely received in the supply recess 112.

In addition, to prevent the tablet from being unintentionally transferred from the separation recess 111 into the supply recess 112 without the assistance of the inclined edge surface 23, the prop 113 may be upwardly inclined toward the supply recess 112.

Other configurations and operations of the present embodiment except for the above description are equal to those of the previously described first embodiment and thus, a repeated description thereof will be omitted herein.

In the above described second embodiment, by providing the bottom ring 2 with the outer diameter larger than the outer diameter of the division block 1, a part of the inclined edge surface 23 and the supporting edge surface 24 of the bottom ring 2 may be located higher than the first embodiment. This assures more reliable transfer of the tablets from the separation recess 111 to the supply recess 112.

Further, by locating the bottom ring around the outer circumferential surface of the lower end of the division block 1, it is unnecessary to form any raised portion for installation of the bottom ring 2. This simplifies the configuration of the division block 1 and consequently, results in easy manufacture of the division block 1.

As is apparent from the above description, a tablet cassette of an automatic tablet packing apparatus according to the present invention has the following several effects.

Firstly, according to the present invention, a division block received in the tablet cassette has a downwardly inclined conical upper surface and also, outwardly raised portions are formed at an outer circumferential surface of the division block below the conical upper surface to allow tablets to be aligned in an upright posture on the outwardly raised portions prior to being moved into transfer passages defined between the outwardly raised portions. This has the effect of assuring smooth supply of the tablets through the transfer passages.

Secondly, according to the present invention, a bottom ring is provided around a lower end of the division block and serves to reduce an interior space between the division block and an inner circumferential surface of a cylindrical portion of the tablet cassette. This may prevent relatively thin tablets from being lodged in the interior space, and consequently, may prevent the tablets from interfering with rotation of the division block.

Thirdly, according to the present invention, when an outer diameter of the bottom ring is sufficiently large to surround the outer circumferential surface of the lower end of the division block, the bottom ring may have an increased height, resulting in more reliable transfer of the tablets from a separation recess to a supply recess of the transfer passage.

Fourthly, according to the present invention, an opening/closing unit is provided to substantially prevent the tablets from being exposed to outside air. This may prevent contamination of the tablets. In addition, with provision of a magnet and a magnetic force sensor, it is possible to monitor whether the opening/closing unit is accurately operated.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A tablet cassette of an automatic tablet packing apparatus comprising:

a tablet cassette body including a receptacle portion having an open upper end, and a cylindrical portion formed below the receptacle portion and having a closed circular lower surface, the circular lower surface of the cylindrical portion being formed at the center thereof with a circular shaft hole, into which a pinion of a cassette pedestal is inserted, and also, at an outer circumferential position thereof with a discharge hole for discharge of a tablet; and a division block rotatably arranged inside the cylindrical portion, the division block having a cylindrical recess indented in the center of a lower surface thereof for engagement of the pinion and at least one transfer passage indented in an outer circumferential surface thereof to transfer the tablet introduced into the receptacle portion downward, wherein the transfer passage includes a separation recess for downward transfer of the tablet, a lower end of which is blocked by a prop, and a supply recess along which the tablet having passed through the separation recess is moved on the outer circumferential surface of the division block to thereby be discharged downward via rotation of the division block, and wherein a bottom ring is provided around a lower end of the division block to transfer the tablet located in the separation recess into the supply recess via rotation of the division block, the bottom ring having an opening for discharge of the tablet, wherein the bottom ring includes a passage edge surface located lower than the prop, an inclined edge surface to cause the tablet located in the separation recess to be moved upward in the separation recess so as to be transferred to the supply recess, and a supporting edge surface located higher than the prop, the passage edge surface, inclined edge surface, and supporting edge surface being formed in succession.

2. The tablet cassette according to claim 1, wherein:

an outer diameter of the bottom ring is larger than an outer diameter of the division block; and the supporting edge surface and the inclined edge surface of the bottom ring are located higher than the lower end of the transfer passage.

3. The tablet cassette according to claim 1, wherein the bottom ring includes an inclined edge surface obliquely extending from a position lower than the prop to a position higher than the prop, to cause the tablet located in the separation recess to be moved upward in the separation recess so as to be transferred to the supply recess, and a supporting edge surface extending from the inclined edge surface and located higher than the prop, the inclined edge surface and supporting edge surface being formed in succession.

4. The tablet cassette according to claim 1, wherein the prop includes a protuberance to prevent the tablet supported on the prop from being unintentionally transferred into the supply recess.

5. The tablet cassette according to any one of claim 1, wherein:

the division block has a conical upper surface obliquely extending downward toward an edge thereof; and a plurality of outwardly raised portions is formed at the outer circumferential surface of the division block below the upper surface with a predetermined interval therebetween.

6. The tablet cassette according to claim 5, wherein the outwardly raised portions are spaced apart downward from the edge of the upper surface by a predetermined distance.

7. The tablet cassette according to claim 1, wherein an outer diameter of the bottom ring installed around the lower end of the division block is equal to an outer diameter of the division block and is located in a space between the division block and the cylindrical portion of the cassette body.

8. The tablet cassette according to claim 1, further comprising:

an opening/closing unit to open or close the discharge hole through which the tablet having passed through the transfer passage is discharged.

9. The tablet cassette according to claim 8, wherein the opening/closing unit includes:

an opening/closing door unit including a door plate configured to come into contact with a lower end of the discharge hole, a rotating shaft extending at one side of the door plate, both ends of which are rotatably coupled to the tablet cassette, an operating bar extending from the rotating shaft, and a spring having one end caught by the operating bar and the other end caught by the tablet cassette to cause the door plate to come into elastic contact with the discharge hole; and an opening/closing actuating unit including a solenoid mounted in the cassette pedestal, and a transfer piece to be pulled rearward by the solenoid and having an upwardly protruding holder to cause the operating bar to be moved rearward and the door plate to be rotated along with the rotating shaft so as to open the discharge hole.

10. The tablet cassette according to claim 9, wherein the transfer piece is provided with a magnet to sense operation of the opening/closing unit, and a transfer channel in which the transfer piece slides forward or rearward is provided with a magnetic force sensor to sense the magnetic force of the magnet.

* * * * *